US009315245B2

(12) United States Patent
Christensen

(10) Patent No.: US 9,315,245 B2
(45) Date of Patent: Apr. 19, 2016

(54) OFFSHORE SYSTEM

(75) Inventor: Claus Dencker Christensen, Albertslund (DK)

(73) Assignee: NATIONAL OILWELL VARCO DENMARK I/S, Brondby (DK)

( * ) Notice: Subject to any disclaimer, the term of this patent is extended or adjusted under 35 U.S.C. 154(b) by 46 days.

(21) Appl. No.: 14/115,690

(22) PCT Filed: Apr. 26, 2012

(86) PCT No.: PCT/DK2012/050138
§ 371 (c)(1),
(2), (4) Date: Dec. 2, 2013

(87) PCT Pub. No.: WO2012/152278
PCT Pub. Date: Nov. 15, 2012

(65) Prior Publication Data

US 2014/0079512 A1 Mar. 20, 2014

(30) Foreign Application Priority Data

May 6, 2011 (DK) ..... 2011 00351

(51) Int. Cl.
*E21B 17/01* (2006.01)
*B63B 27/24* (2006.01)
*B63B 27/34* (2006.01)

(52) U.S. Cl.
CPC ..... *B63B 27/24* (2013.01); *B63B 27/34* (2013.01); *E21B 17/015* (2013.01)

(58) Field of Classification Search
CPC ..... E21B 17/015; E21B 17/017; F16L 1/20; B63B 27/24; B63B 27/34
USPC ..... 166/367, 352, 355; 405/168.1, 224.2, 405/224.3
See application file for complete search history.

(56) References Cited

U.S. PATENT DOCUMENTS 4,182,584 A 1/1980 Panicker
4,266,886 A * 5/1981 Milton ..... 405/169
(Continued)

FOREIGN PATENT DOCUMENTS

CN 101845940 A 9/2010
EP 0 250 069 A2 12/1987
(Continued)

OTHER PUBLICATIONS

"Recommended Practice for Flexible Pipe" ANSI/API Recommended Practice 17B, Fourth Edition, Jul. 2008.
(Continued)

*Primary Examiner* — Matthew R Buck
(74) *Attorney, Agent, or Firm* — Pearne & Gordon LLP

(57) ABSTRACT

The invention relates to an offshore system for transferring fluid at least partly below sea surface. The offshore system comprises a flexible transporting unit and a first movable structure fix-point with a nominal position and a second structure fix-point arranged at a distance to seabed and at a lower position relative to the sea surface than the first structure fix-point. The flexible transporting unit is fixed to respectively the first structure fix-point and the second structure fix-point to provide a catenary liftable length section of the flexible transporting unit extending between the first structure fix-point and the second structure fix-point, wherein the catenary liftable length section has a touch down point at seabed at nominal position and where the distance to the second structure fix-point can be increased sufficiently to lift the catenary liftable length section from the seabed to form a catenary.

24 Claims, 7 Drawing Sheets

(56) References Cited

U.S. PATENT DOCUMENTS

| | | | | |
|---|---|---|---|---|
| 4,400,109 | A | 8/1983 | Gentry | |
| 4,570,716 | A * | 2/1986 | Genini et al. | 166/346 |
| 4,704,050 | A * | 11/1987 | Wallace | 405/224.2 |
| 4,730,677 | A * | 3/1988 | Pearce et al. | 166/345 |
| 4,740,050 | A | 4/1988 | Husain | |
| 4,906,137 | A | 3/1990 | Maloberti | |
| 5,427,046 | A * | 6/1995 | Brown et al. | 114/230.13 |
| 5,505,560 | A * | 4/1996 | Brown et al. | 405/195.1 |
| 5,957,074 | A | 9/1999 | de Baan | |
| 6,085,799 | A | 7/2000 | Kodaissi | |
| 6,109,833 | A | 8/2000 | Savy | |
| 6,123,114 | A | 9/2000 | Seguin | |
| 6,146,052 | A * | 11/2000 | Jacobsen et al. | 405/169 |
| 6,276,874 | B1 | 8/2001 | Norholmen | |
| 6,364,022 | B1 * | 4/2002 | Kodaissi et al. | 166/367 |
| 6,538,198 | B1 | 3/2003 | Wooters | |
| 6,857,822 | B2 * | 2/2005 | Hooper et al. | 405/224.4 |
| 6,869,253 | B2 * | 3/2005 | Biolley | 405/224.3 |
| 7,287,936 | B2 * | 10/2007 | Streiff et al. | 405/224.2 |
| 7,789,588 | B2 * | 9/2010 | De Aquino et al. | 405/216 |
| 7,793,723 | B2 * | 9/2010 | Vedeld et al. | 166/355 |
| 8,733,446 | B2 * | 5/2014 | Espinasse et al. | 166/350 |
| 2002/0054789 | A1 * | 5/2002 | Alliot | 405/224.2 |
| 2003/0143034 | A1 * | 7/2003 | Kelm et al. | 405/203 |
| 2004/0028477 | A1 * | 2/2004 | Kelm et al. | 405/203 |
| 2007/0081862 | A1 | 4/2007 | Wolbers | |
| 2007/0163481 | A1 | 7/2007 | Vedeld | |
| 2008/0014026 | A1 | 1/2008 | Routeau | |
| 2011/0017465 | A1 * | 1/2011 | Wales et al. | 166/339 |
| 2011/0129305 | A1 * | 6/2011 | Withall et al. | 405/224.2 |
| 2011/0155383 | A1 * | 6/2011 | Christiansen et al. | 166/345 |
| 2013/0216317 | A1 * | 8/2013 | Tan et al. | 405/224.3 |

FOREIGN PATENT DOCUMENTS

| | | | |
|---|---|---|---|
| EP | 0250069 | A2 | 12/1987 |
| EP | 2236737 | A2 | 6/2010 |
| GB | 2206144 | A | 12/1988 |
| WO | 99/66169 | A2 | 12/1999 |
| WO | 01/61232 | A1 | 8/2001 |
| WO | 03/033856 | A1 | 4/2003 |
| WO | 2011/072687 | A1 | 6/2011 |
| WO | 2011/076210 | A1 | 6/2011 |

OTHER PUBLICATIONS

"Specification for Unbonded Flexible Pipe" ANSI/API Specification 17J, Third Edition, Jul. 2008.

Chinese Office action for 201280022141.2 dated Dec. 23, 2015.

Danish Search Report for PA 2013 70685 dated Feb. 15, 2016.

* cited by examiner

OFFSHORE SYSTEM

TECHNICAL FIELD

The present invention concerns an offshore system for transferring fluid, such as petrochemical fluids e.g. oil and/or gas at least partly below sea surface. Such offshore systems are for example useful for transferring fluids from a subsea production well to a sea surface installation, e.g. a vessel.

BACKGROUND ART

Offshore systems for transferring fluids, such as petrochemical fluids of the above mentioned type are well known in the art. Such offshore systems in which fluids is transferred from wellheads or other structures, such as connecting elements (manifolds) located at the seabed to a higher level, e.g. to a sea surface installation, are also referred to as riser systems. Such offshore systems are usually subjected to very high and varying forces due to wind, water waves, water current, shifting water levels as well as gravity and friction upon engagement with the seabed. In particular in offshore systems with flexible pipe(s) which are adapted to transporting fluids from a seabed station to a floating station, e.g. a sea surface floating station such as a vessel, are subjected to high forces including pulling due to movements of the floating station. Also there may be a risk of overbending and thereby damaging the flexible pipe.

A number of configurations for flexible pipe systems have for example been described in Recommended Practice for Flexible Pipe, API 17B, fourth edition, 2008, section 4.2.2.3 for example the configurations of nominal positions for lifting of oil, known under the name of "free hanging catenary", "LAZY S" or "LAZY WAVE" and "STEEP S" or "STEEP WAVE," respectively.

In these configurations the hoses extend in a catenary between the sea surface installation and seabed or/and between the sea surface installation and intermediate positive buoyancy element capable of imparting to the hose, over a portion of its length, a curved configuration of concavity turned toward the seabed.

U.S. Pat. No. 4,740,050 describes an offshore system which is corresponding to the free hanging catenary structure described in Recommended Practice for Flexible Pipe, API 17B, fourth edition, 2008. The riser system has a riser with an J-shaped configuration for transporting hydrocarbon fluids from a subsea manifold or wellheads to a surface vessel. The riser has a horizontal section, an upright section, and a sag bend section interconnecting the horizontal and upright sections. The horizontal section is connected at one end to the subsea manifold and extends along and in frictional engagement with the seabed away from the manifold. The upright section has a vertical end part coupled to the surface vessel. The vessel can remain in position with dynamic thrusters or mooring lines, and the vessel remains on station applying horizontal pull to the riser while heading into the prevailing sea and as hydrocarbon fluids are transported from the manifold through the riser to the surface vessel. The horizontal pull on the riser due to the surface vessel is taken up by friction forces between the horizontal section of the riser and the seabed. The frictional force between the flexible pipe and the seabed can become very considerable and in practice this system is only accepted in systems operating at very low water depth, with low water turbulence and where the pulling in the pipe provided by the vessel can be kept at a very low level. In general flexible pipes in such systems are often subjected to damage due to the friction with the seabed.

U.S. Pat. No. 4,906,137 describes a riser system for transferring fluid between a structure on the subsea floor and a support on the sea surface. A lower portion of a subsea oil delivery hose is held taut between buoyant devices installed on the hose and a stationary point on the subsea floor. A portion of the lower part of the hose, connected to the stationary point, has a curved portion that is concave in the direction of a wellhead to which the hose is connected. The structure has the main aim of preventing overbending of the pipe.

A similar system is described in U.S. Pat. No. 6,109,833. This system comprises at least one flexible pipe extending in a catenary curve. An intermediate buoyancy and support member associated with the pipe splits the pipe into two parts, an upper part and a lower part. The intermediate member imparts to a region of the upper part a concavity facing the seabed. A yoke on the pipe and a cable from the yoke retain at least one region of the lower part of the pipe. The cable is connected to a fixed member on the seabed for tensioning the lower part of the pipe. The cable and the fixed member impart a bend to the region of the lower part of the pipe, the concavity of which faces the equipment on the seabed. The intermediate member is connected to the fixed member. The cable between the lower part of the pipe and the fixed member has a length at least equal to the minimum bend radius of the lower part of the flexible pipe.

Both of the above systems work often quite well, but they are relatively expensive and require relatively large horizontal space.

WO 99/66169 describes a riser structure for transferring fluids between a construction at the sea floor and a second construction at or close to the surface. The riser has an upper essentially vertically extending part connected in its upper end to the construction at the sea surface; an intermediate part of the riser connected to one or more buoyancy elements along at least a part of its length; and a lower part having a lower end connected to the construction at the sea floor and one or more weight elements connected to the lower end of the riser. To balance the force between the buoyancy modules and the weight modules and possibly pulling force, the riser is anchored with a "chain", where the anchoring length can be regulated. Also this system is rather expensive both due to the extra equipment required (buoyancy modules and similar) but also due to a complicated installation of the system.

US 2007/0081862 describes a riser structure, wherein the pipeline extends at least in part on a seabed and curves upwardly from the seabed along a curved section thereof. The pipeline extending toward a delivery end provided at the water surface, wherein a connecting device connects the pipeline at a coupling point to an anchoring device at the seabed for preventing the coupling point from moving upward. A buoyancy module is ensuring that the anchoring line is taut and controls the touch down point. Thereby undesired friction between the pipe and the seabed can be avoided, but also this system is rather expensive and difficult to install.

GB 2 206 144 describes a method for producing oil via a flexible riser comprising a length A-B of the riser extending from a well and bending under its own weight to a part B-C capable of lateral movement and extending more or less horizontally, optionally kept above seabed by the provision of a number of buoyancy modules thereon, and from there a length B-C capable of vertical and lateral movement which rises up to a sea surface installation, a production vessel. The riser has greater stiffness in torsion than in bending. This allows for a highly specific movement pattern of the vessel in a fixed pipe distance to the well is allowed, see second figure of that patent. How to address undesired friction between pipe and seabed is not discussed. It is evident from such fixed movement pattern that in the case where the riser is not provided with buoyancy modules the horizontal part of the riser will scrape along the seabed during such movements of the vessel.

The object of the invention is to provide an offshore system comprising a flexible transporting unit for transferring fluid at least partly below sea surface, and preferably between a seabed installation and a floating installation above seabed e.g. a sea surface installation, which offshore system is relatively simple, simple to install and where the risk of damaging the flexible transporting unit when subjected to pulling forces is kept at a low level.

The present invention provides a novel offshore system, which meets this object. The offshore system of the invention and embodiments thereof have shown to have a large number of advantages which will be clear from the following description.

The offshore system of the invention for transferring fluid at least partly below sea surface is as defined in the claims and as described below. The offshore system of the invention comprises a flexible transporting unit and a first movable structure with a first movable structure fix-point which has a nominal position and a second structure with a second structure fix-point arranged at a distance to seabed. The second structure fix-point is further arranged at a lower position relative to the sea surface than the first structure fix-point. The flexible transporting unit is fixed to respectively the first structure fix-point and the second structure fix-point. The section of the flexible transporting unit between the first structure fix-point and the second structure fix-point is in the following called the catenary liftable length section of the flexible transporting unit. This catenary liftable length section of the flexible transporting unit which is extending between the first structure fix-point and the second structure fix-point has a touch down point at seabed at nominal position. Further the catenary liftable length section of the flexible transporting unit is arranged such that if the first structure fix-point is moved out of its nominal position, the distance to the second structure fix-point can be increased sufficiently to lift the catenary liftable length section from the seabed to form a catenary. The term "nominal position" has the meaning as defined below. In one embodiment the first structure fix-point is in its initial position without any significant displacement in any direction, where "significant" depending on length and type of transporting unit used for a certain longitudinal flexibility of the length of the flexible transport unit, such that it is not to be lifted off the seabed by that insignificant displacement.

The position of the first structure fix-point may typically be displaced from said nominal position by said first structure fix-point being moved along a direction primarily away, but also sometimes towards said second structure fix-point.

In other words the catenary liftable length section of the flexible transporting unit is not fixed to the seabed to have a stationary touch down point and has as such some similarities to a free hanging catenary structure. However, due to the position of the second structure fix-point at a distance from the seabed, the part of the catenary liftable length section which in its nominal position is laid on the seabed can be totally lifted therefrom upon pulling in the flexible transporting unit. Thereby possible friction forces between the seabed and the catenary liftable length section are kept at a relatively low level compared to prior art free hanging catenary structures as described above. Simultaneously the offshore system of the invention is simple to install and less costly than most of the prior art offshore systems.

The offshore system of the invention and the flexible transporting unit of the offshore system can thereby accommodate to forces applied to it due to weather conditions as well as due to movement of the flexible transporting unit via movement of the first structure and optionally the second structure, while simultaneously providing a high degree of stability and control over resulting movements of the flexible transporting unit such that the risk of damaging the flexible transporting unit is reduced.

Furthermore, it has been found that the offshore system of the invention can be applied at almost any water depth, but preferably at water depth up to about 1000 m, also in situations where a free hanging catenary structure will not be accepted.

In principle the offshore system of the invention can in one embodiment be described as an offshore system with a substantially free hanging structure with the additional feature that the flexible transporting unit between touch down in nominal position and a subsea structure for example a seabed installation is lifted from the seabed by a second structure fix-point, e.g. a seabed support unit, to a preselected height. When a pull occur in the flexible transporting unit from the first structure, e.g. a vessel, the resistance between the seabed and the flexible transporting unit will initially resist the pulling. When the pulling exceeds a certain level the flexible transporting unit will start to lift from the seabed and eventually the whole catenary liftable length section is lifted from the seabed to form a catenary.

The first (movable) structure fix-point means herein the fix-point of the first structure to which the flexible transporting unit is fixed. The second structure fix-point means herein the fix-point of the second structure to which the flexible transporting unit is fixed.

In order for an element of the offshore system to be in its nominal position, all other movable elements of the offshore system should preferably be in their respectively nominal position as well, in particular if these positions influence each other.

The nominal position of the first movable structure fix-point is the position to which it is adapted to be held when the first structure is essentially free of forces generated by weather conditions (wind, water current and waves) and at shallow water. The first structure fix-point is usually held in this position by mooring e.g. using mooring lines and optionally by uplifting elements (e.g. buoyancy modules).

The horizontal displacement distance is determined as the smallest distance between vertical, parallel lines through the first and the second structure fix-points.

The vertical displacement distance is determined as the smallest distance between horizontal, parallel lines through the first and the second structure fix-points.

A touch down point is herein defined as a point of a flexible transporting unit extending from above the seabed, e.g. from the first structure fix-point, and into physical contact with the seabed, which point of the flexible transporting unit is immediately adjacent to the part of the flexible transporting unit above the seabed e.g. the point of the flexible transporting unit closer to the first structure fix-point and in physical contact with the seabed.

The touch down point at nominal position (also called the nominal touch down point) is the touch down point when the first structure fix-point is in its nominal position, the second structure fix-point is either fixed (non-movable) or in its nominal position and the flexible transporting unit is free of forces generated by weather conditions (wind, water current and waves) and at shallow water.

The term 'seabed' is generally used to denote the subsea floor. The offshore system may preferably be applied for transporting fluid between a seabed installation and an installation vertically displaced from the seabed, e.g. a sea surface installation. The seabed installation is an installation in or in contact with the seabed.

The seabed installation may for example be a fixed installation, such as a well, an anchoring installation and/or a secondary fixed subsea structure. The skilled person will understand that the type of seabed installation is not important for the present invention in general and accordingly any seabed installation can be applied in the present invention.

The offshore system may comprise two or more flexible transporting units, but is in the following described mainly with one flexible transporting unit.

The flexible transporting unit may be any kind of flexible transporting unit used in offshore applications. In one embodiment the flexible transporting unit is an unbonded flexible offshore pipe. In one embodiment the flexible transporting unit is an unbonded flexible transporting unit comprising an internal sealing sheath and at least two reinforcement layers which are not bonded to each other.

Flexible unbonded pipes which may be part of an offshore system of the invention are for example described in the standard "Recommended Practice for Flexible Pipe", ANSI/API 17 B, fourth Edition, July 2008, and the standard "Specification for Ubonded Flexible Pipe", ANSI/API 17J, Third edition, July 2008. Such pipes usually comprise an inner liner also often called an inner sealing sheath or an inner sheath, which forms a barrier against the outflow of the fluid which is conveyed in the bore of the pipe, and one or more armouring layers. In general flexible pipes are expected to have a lifetime of 20 years in operation.

Examples of unbonded flexible pipes are e.g. disclosed in WO0161232A1, U.S. Pat. No. 6,123,114 and U.S. Pat. No. 6,085,799.

The term "unbonded" means in this text that at least two of the layers including the armouring layers and polymer layers are not bonded to each other. In practice the known pipe normally comprises at least two armouring layers located outside the inner sealing sheath. These armouring layers are not bonded to each other directly or indirectly by other layers along the pipe. Thereby the pipe becomes bendable and sufficiently flexible to roll up for transportation.

In one embodiment the flexible transporting unit is a bonded flexible offshore pipe. The flexible transporting unit may for example be a flexible riser or an umbilical. The offshore system may comprise a plurality of flexible transporting units, e.g. comprising a plurality of rises, such as a plurality of risers and optionally at least one umbilical. Flexible transporting units—sometimes also called jumpers—such as risers and umbilicals are well known in the art. Risers are usually applied for transportation of petrochemical products from the seabed to a sea surface installation such as a weathervaning vessel. Umbilicals are often used for transporting fluids, electricity, signals and other to and/or from installations at or beyond the seabed.

In one embodiment the flexible transporting unit is a flexible pipe. In one embodiment the flexible transporting is an umbilical. In one embodiment the flexible transporting unit is a flexible riser pipe, such as a jumper.

In one embodiment the flexible transporting unit comprises two or more pipes connected to each other and in fluidic connection with each other. It is well known to the skilled person how to connect pipes to each other to obtain a fluidic connection. The two or more connected pipes may be of similar types or of different types, provided that at least one of the pipes is a flexible pipe.

In one embodiment the flexible pipe system comprises two or more flexible transporting units, preferably arranged in substantially side-by-side relation to each other. The flexible transporting units may be of similar types or of different types, of similar sizes or of different sizes.

The first movable structure—also referred to a simply "the first structure"—is in one embodiment a sea surface installation i.e. an installation located at or near the sea surface—usually a floating structure.

The sea surface installation may in practice be any type of installation arranged at or near the sea surface, where the term "near" is used to mean closer to the sea surface than to the seabed, preferably up to about 20 m below the sea surface. Examples of sea surface installations include platforms and vessels. In one embodiment the sea surface installation is a floating installation, preferably selected from a vessel and a floating platform.

In one embodiment the sea surface installation is a moored floating installation.

In one embodiment the first structure is a vessel, such as a weathervaning vessel or a spread-moored vessel.

Weathervaning vessels are often used in shallow waters. An example of a shallow water system comprising a weathervaning vessel which may in one embodiment be used in combination with the present invention is described in co-pending application DK PA 2009 01333. In another embodiment a hang-off system as described in co-pending application DK PA 2009 01376 comprising a weathervaning vessel is used in combination with the present invention. However, it should be observed that any weathervaning vessel as well as any spread-moored vessel in practice can be applied as a sea surface installation in the present invention.

A 'floating weathervaning vessel' or merely a 'weathervaning vessel' is a vessel from which one or more flexible transporting units are leading to a subsea structure. Such weathervaning vessels as well as spread-moored vessels are known to the skilled person and usually comprise an external turret system or an internal turret system. The internal turret system leads the flexible transporting units through the hull bottom whereas the external turret system leads the flexible transporting unit from a topside hang-off structure extending beyond the hull and the rail of the vessel. A weathervaning vessel is usually moored to the seabed but may also in certain situations be moored by line to one or more fixed structures, and is usually moored while still having a large freedom to move to adapt to forces applied to the weathervaning vessel e.g. by wind, water current and waves.

In shallow water the weather conditions have a vast influence on movements of a vessel and even though the weathervaning vessel is moored, the movements of the weathervaning vessel may become quite considerable.

The fix-point of the first structure (the first structure fix-point) may be anywhere it is practical to arrange and will usually be arranged using a clamp or similar equipment.

In one embodiment the first structure is a mid water arch, the mid water arch is preferably anchored to the seabed and/or moored to provide its nominal position. The mid water arch may for example comprise gutters. The flexible transporting unit is in one embodiment arranged to be supported by gutters and is fixed by a clamping system. Optionally the flexible transporting unit extends from the mid water arch further to a sea surface installation.

A mid water arch is in particular useful if the water is relatively deep such as at least about 50 m or preferably at least about 100 m.

In the technical field of marine hydrocarbon production the term "a mid water arch" is a specific term denoting a transporting unit support structure, which is separately provided relative to the transporting unit and. Such mid water arch is preferably fixed or moored to the seabed. The mid water arch often exhibits an arch shape for one or more of the transporting units to rest upon, either fixedly or free to move over this structure, and is provided at a position in the water such that it can support the transporting units at a relatively fixed position hovering above seabed but below sea surface, i.e. mid water. The support structure can be provided with anchoring, mooring, buoys, lines, or fixed constructions or the like in order to keep it positioned correctly, at least at a fixed distance to the position where the moorings are secured in the seabed, or alternatively at a fixed position relative to the seabed. Often the buoys needed are very large in order to support a plurality of transporting units, such as flexible pipes. Thus, the resulting mid water arch tend to span several m2, such as 100-200 m2 of seabed, depending on types and number of transporting units being used.

In one embodiment of the offshore system the first structure fix-point is a fix-point of the first structure above sea surface, such as a fix-point to a turret of a vessel or to a platform.

In one embodiment of the offshore system the first structure fix-point is a fix-point below sea surface, such as a fix-point to an internal turret system of a vessel or to a platform or a clamping to a mid water arch.

The second structure is preferably a structure which is capable of holding the flexible transporting unit above the seabed at least where it is connected to the second structure fix point. The second structure is preferably a relatively rigid structure fixed to the seabed or a mid water arch moored or anchored to the seabed.

In one embodiment the second structure is a substantially rigid structure fixed to the seabed in a relatively rigid fixation. The second structure may be fixed to the seabed by any method, e.g. by being held to the seabed with a heavy anchoring element (a dead weight), by being partly embedded in the seabed or by being provided with one or more piles which are driven into the seabed, e.g. in a substantially vertical direction.

In one embodiment the second structure is a pile structure, comprising one or more piles, such as a monopile. Monopiles are preferred because they are simple and cost effective to install. Multipile structures may however be stronger and more stable, and may in certain applications be the preferred choice.

In one embodiment the second structure is a mid water arch, the mid water arch is preferably anchored to the seabed and/or moored to provide a nominal position.

In case the second structure is a movably structure, such as a mid water arch, the "nominal position" of the offshore system including the second movably structure fix-point is the position to which it is adapted to be held when the second structure is essentially free of forces generated by weather conditions (wind, water current and waves) and at shallow water.

In one embodiment the second structure comprises a support structure to which the flexible transporting unit is clamped to provide the second structure fix-point. This support structure is preferably an upwards surface of the second structure and it may e.g. be provided with gutters, into which the flexible transporting unit is laid and is fixed by a clamping system.

The second structure fix-point is preferably provided at a preseclected distance to the seabed, which preselected distance is normally selected in relation to the distance, in particular the horizontal distance between the first structure fix-point and the second structure fix-point.

The second structure fix-point is arranged at a distance to seabed and at a lower position relative to the sea surface than the first structure fix-point.

In one embodiment the second structure fix-point is arranged at a distance from the seabed which is at least about 0.5 m, such as at least about 1 m, such as at least about 2 m, such as at least about 5 m, such as at least about 10 m.

The flexible transporting unit is fixed to respectively the first structure fix-point and the second structure fix-point to provide a catenary liftable length section of the flexible transporting unit extending between the first structure fix-point and the second structure fix-point.

The term "catenary liftable length section" means that the length section of the flexible transporting unit between the first structure fix-point and the second structure fix-point can be lifted to hang free in a catenary curve, i.e. as in a free hanging catenary, supported at the fix-points and essentially acted on only by its own weight and forces provided by water and optionally wind if the first structure fix-point is above water.

The catenary liftable length section of the flexible transporting unit should naturally be longer than the distance between the first structure fix-point in its nominal position and the second structure fix-point since the flexible transporting unit otherwise will be subjected to excessive pulling and the flexible transporting unit will not have any touch down point. It is often desired to have a substantially extra length of the catenary liftable length section beyond the actually distance between the first structure fix-point in its nominal position and the second structure fix-point, because this gives increased security against damage of the flexible transporting unit when the first structure fix-point is subjected to movements. On the other hand the extra length of the catenary liftable length section beyond the actually distance between the first structure fix-point in its nominal position and the second structure fix-point should not be too long since this may result in risk of overbending of the flexible transporting unit.

In one embodiment the distance between the first structure fix-point in its nominal position and the second structure fix-point is about 0.95 times or less than the length of the catenary liftable length section of the transporting unit, preferably the first structure fix-point in its nominal position is arranged at a distance to the second structure fix-point which is about 0.9 times or less, such as about 0.85 times or less, such as about 0.8 times or less, such as about 0.75 times or less, such as about 0.7 times or less, such as about 0.65 times or less, such as about 0.6 times or less, such as about 0.55 times or less, such as about 0.5 times or less than the length of the catenary liftable length section of the transporting unit.

In one embodiment the first structure fix-point in its nominal position is arranged at a distance to the second structure fix-point which is between about 0.5 and about 0.98 times the length of the catenary liftable length section of the flexible transporting unit, preferably between about 0.6 and about 0.9 times the length of the catenary liftable length section of the flexible transporting unit.

As mentioned above the second structure fix-point is arranged at a lower position relative to the sea surface than the first structure fix-point in nominal position. This means in other words that the first structure fix-point is arranged vertically displaced relative to the second structure fix-point.

The invention also comprises an embodiment where the first structure fix-point in nominal position is arranged substantially above the second structure fix-point. However, in order to decrease the possible risk of overbending the flexible transporting unit, it is preferred that the first structure fix-point in nominal position is also arranged horizontally displaced relative to the second structure fix-point.

In one embodiment the first structure fix-point is arranged horizontally displaced with a first horizontal displacement distance at nominal position to the second structure fix-point and vertically displaced with a first vertical displacement distance at nominal position to the second structure fix-point, wherein the first horizontal displacement distance is at least about 1 m, such as at least about 3 m, such as at least about 5 m, such as at least about 15 m, such as at least about 20 m, such as at least about 30 m, such as at least about 40 m, such as at least about 50 m.

In practice the first horizontal displacement distance at nominal position can be very large in particular if the second structure fix-point is arranged with a relatively large distance to the seabed and/or if the first vertical displacement distance at nominal position is also large.

In one embodiment the first horizontal displacement distance is between about 1 m and about 300 m, such as between about 2 m and about 200 m, such as between about 5 m and about 100 m, such as between about 6 m and about 50 m.

In one embodiment wherein the first structure fix-point is arranged horizontally displaced with a first horizontal displacement distance at nominal position to the second structure fix-point and vertically displaced with a first vertical displacement distance at nominal position to the second structure fix-point, the first horizontal displacement distance is between about 0.02 and about 0.95 times the length of the catenary liftable length section of the flexible transporting unit, such as between about 0.05 and about 0.9 times the length of the catenary liftable length section of the flexible transporting unit, such as between about 0.1 and about 0.8 times the length of the catenary liftable length section of the flexible transporting unit, such as between about 0.15 and about 0.7 times the length of the catenary liftable length section of the flexible transporting unit.

The desired vertical displacement distance at nominal position depends largely on the depth of water. However, if the water is very deep it is often desired to place the first structure fix-point at a distance below the sea surface, e.g. selecting a mid water arch as first structure.

In one embodiment the first structure fix-point is arranged vertically displaced with a first vertical displacement distance at nominal position to the second structure fix-point, wherein the first vertical displacement distance is up to a max distance determined as the distance between about 20 m above the sea surface and the seabed at the touch down point, such as the distance between about 10 m above the sea surface and the seabed at the touch down point, such as the distance between the sea surface and the seabed at the touch down point, such as the distance between about 10 m below the sea surface and the seabed at the touch down point such as the distance between about 20 m the sea surface and the seabed at the touch down point.

In one embodiment the first structure fix-point is arranged vertically displaced with a first vertical displacement distance at nominal position to the second structure fix-point, wherein the first vertical displacement distance is between a max distance determined as 1.5 times the distance from about the sea surface to about the seabed at the touch down point and a min distance determined as 0.1 times the distance from about the sea surface to about the seabed at the touch down point, such as between a max distance determined as 1.2 times the distance from about the sea surface to about the seabed at the touch down point and a min distance determined as 0.3 times the distance from about the sea surface to about the seabed at the touch down point, such as between a max distance determined as the distance from about the sea surface to about the seabed at the touch down point and a min distance determined as 0.5 times the distance from about the sea surface to about the seabed at the touch down point.

Generally it is desired to adjust the catenary liftable length section to the first horizontal displacement distance at nominal position and the first vertical displacement distance at nominal position to the second structure fix-point to provide that there is no substantial risk of overbending the flexible transporting unit.

In one embodiment wherein the first structure fix-point is arranged horizontally displaced with a first horizontal displacement distance at nominal position to the second structure fix-point and vertically displaced with a first vertical displacement distance at nominal position to the second structure fix-point, the sum of the first horizontal displacement distance and the first vertical displacement distance is selected to be between about 0.7 and about 1.5 times the length of the catenary liftable length section of the flexible transporting unit, such as between about 0.8 and about 1.2 times the length of the catenary liftable length section of the pipe, such as between about 0.9 and about 1.1 times the length of the catenary liftable length section of the transporting unit, such as between about 0.95 and about 1 times the length of the catenary liftable length section of the transporting unit.

As mentioned above the second structure fix-point is arranged at a distance to seabed. This distance between the second structure fix-point and the seabed may preferably be selected in relation the first horizontal displacement distance.

If the distance between the second structure fix-point and the seabed is relatively low there is a potential risk that the flexible transporting unit may be subjected to undesired friction forces due to sliding along the seabed while additionally being subjected to high pulling forces and tensile stress. On the other hand the distance between the second structure fix-point and the seabed should not be too large since this will require additional length of the flexible transporting unit and it may also add to the cost to provide the distance between the second structure fix-point and the seabed to be longer than required.

By selecting the distance between the second structure fix-point and the seabed in relation to the first horizontal displacement distance at nominal position, a very stable offshore system can be obtained where friction forces and tensile stress applied to the flexible transporting unit when the first structure fix-point is moved out of its nominal position can be kept at a desirable low level, and further more the length of the catenary liftable length section can be optimized to provide a desired extra length of the catenary liftable length section beyond the actually distance between the first structure fix-point in its nominal position and the second structure fix-point, to ensure that excessive movements of the first structure fix-point—e.g. in case of storm or similar—does not result in damage of the flexible transporting unit, but merely that the catenary liftable length section is lifted from the seabed to form a catenary.

In one embodiment the first structure fix-point is arranged horizontally displaced with a first horizontal displacement distance at nominal position to the second structure fix-point and the second structure fix-point is arranged at a distance from the seabed which is in the interval from about 0.05 times and 1 time the first horizontal displacement distance, such as from about 0.1 times and 0.9 times the first horizontal displacement distance, such as from about 0.15 times and 0.7 times the first horizontal displacement distance, such as from about 0.2 times and 0.5 times the first horizontal displacement distance.

In one embodiment the first structure fix-point is arranged horizontally displaced with a first horizontal displacement distance and displacement direction at nominal position to the second structure fix-point, wherein said touch down point at seabed at nominal position is placed in a direction from the first structure fix-point which is substantially parallel to the displacement direction +/−30 degree. By arranging the offshore system such that the touch down point at seabed at nominal position is placed in a direction from the first structure fix-point which is parallel to or cross the displacement direction at nominal position with an angle of 30 degree or less, the risk of overbending the flexible transporting unit is reduced.

The flexible transporting unit is fixed to the first structure fix-point and the second structure fix-point. In one embodiment the flexible transporting unit is substantially provided by said catenary liftable length section, and preferably the flexible transporting unit is connected to a secondary transporting unit system at the second structure fix-point and optionally additionally at the first structure fix-point to provide further transportation of the fluid.

In one embodiment the flexible transporting unit extends beyond at least one of the first structure fix-point and the second structure fix-point.

In one embodiment the flexible transporting unit or a secondary transporting unit system extends beyond the second structure fix-point in a direction away from the second structure fix-point which preferably also is a direction away from the touch down point at seabed at nominal position. The flexible transporting unit or a secondary transporting unit system extends beyond the second structure fix-point in a direction away from the second structure preferably lead to a seabed structure such as a well.

As indicated the flexible transporting unit or a secondary transporting unit system extending beyond the second structure fix-point may be angled with respect to the horizontal displacement direction.

In one embodiment the flexible transporting unit in its catenary liftable length section is free of local buoyancy module(s).

In one embodiment the flexible transporting unit in its catenary liftable length section comprises a substantially continuous buoyancy layer along its length.

It should be emphasized that the term "comprises/comprising" when used herein is to be interpreted as an open term, i.e. it should be taken to specify the presence of specifically stated feature(s), such as element(s), unit(s), integer(s), step(s) component(s) and combination(s) thereof, but does not preclude the presence or addition of one or more other stated features.

All features of the inventions including ranges and preferred ranges can be combined in various ways within the scope of the invention, unless there are specific reasons for not combining such features.

BRIEF DESCRIPTION OF DRAWINGS

The invention will be explained more fully below in connection with a preferred embodiment and with reference to the drawings in which.

The figures are schematic and simplified for clarity. Throughout, the same reference numerals are used for identical or corresponding parts.

Figure 1A:
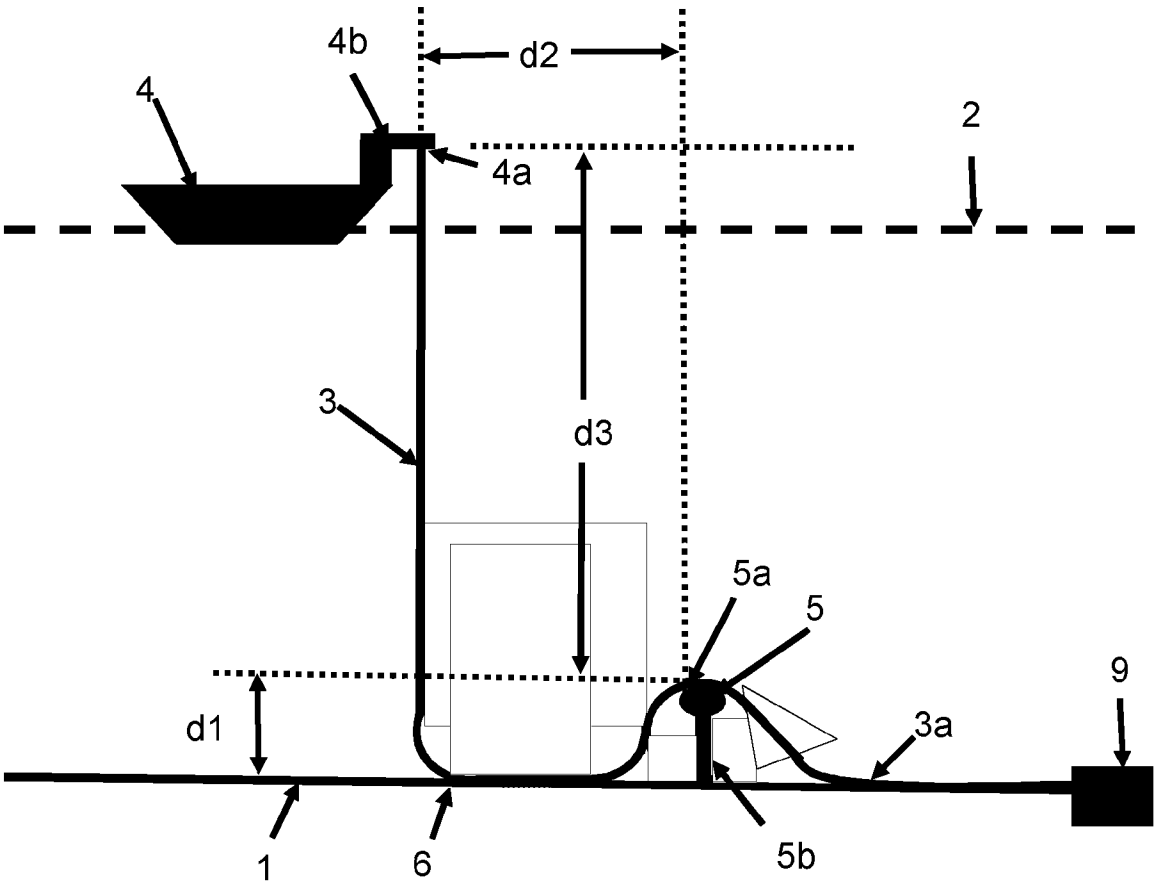
FIG. 1*a* is a schematic side view of an offshore system in nominal position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention is defined by the features of the independent claim(s). Preferred embodiments are defined in the dependent claims. Any reference numerals in the claims are intended to be non-limiting for their scope.

Figure 1B:
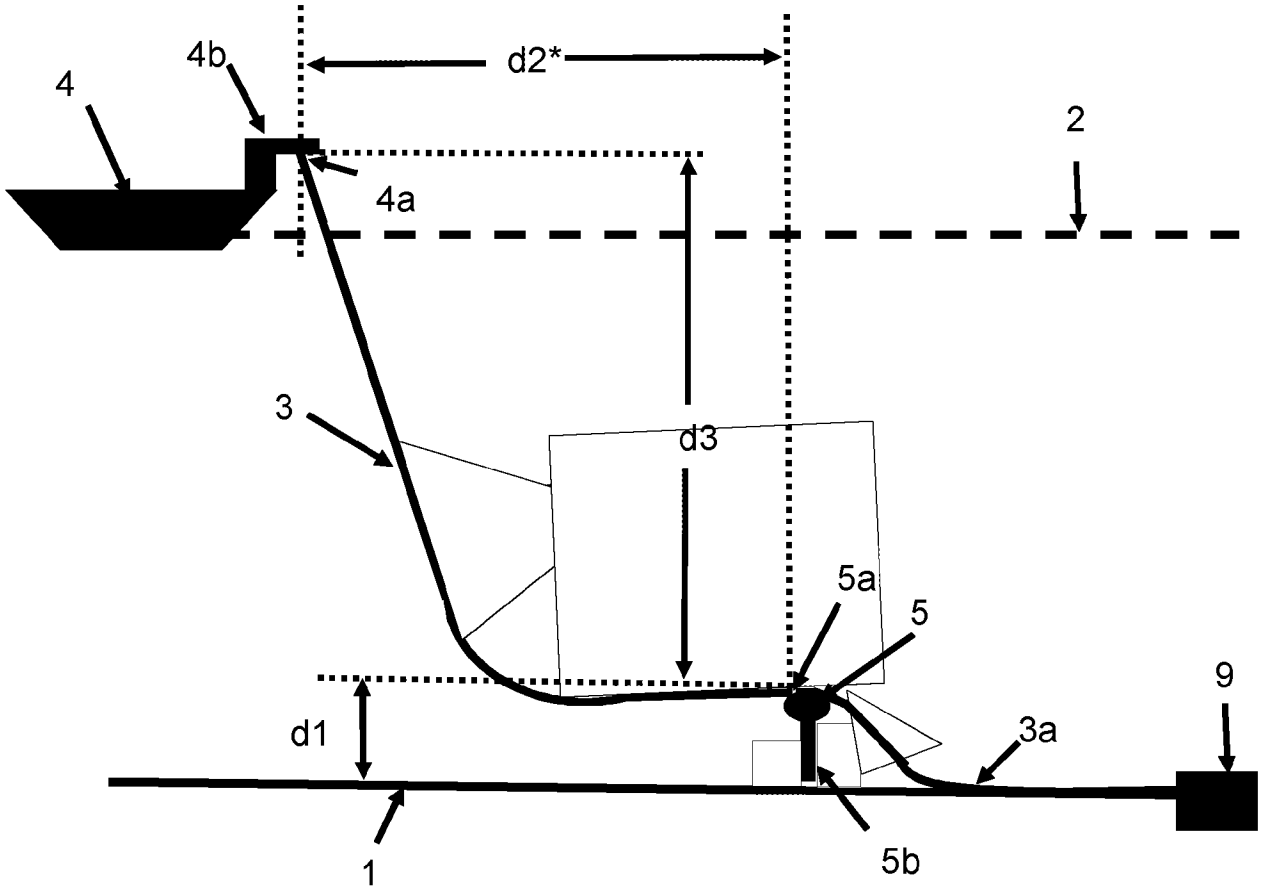
FIG. 1*b* is a schematic side view of the offshore system of FIG. 1*a* is out of its nominal position.

The offshore system shown in FIG. 1*a* and FIG. 1*b* is in its nominal position in FIG. 1*a* is and out of its nominal position in FIG. 1*b*. The seabed is indicated with a line 1 and the sea surface is indicated with a dotted line 2. The offshore structure comprises a flexible transporting unit in the form of a flexible pipe 3 and a first movably structure fix-point 4*a* and a second structure fix-point 5*a*. The first movably structure fix-point 4*a* is a fix-point to a turret 4*b* of a vessel 4, such as a weathervaning vessel. Although not shown, the vessel 4 will usually be moored to the seabed 1, by mooring linen, for example such that it can weathervane around the turret 4*b*.

The second structure fix-point 5*a* is a fix-point to a subsea structure comprising support structure 5 and a pillar 5*b*, such that the fix-point 5*a* is arranged at a horizontal distance d1 from the seabed 1.

The second structure fix-point 5*a* is arranged at a lower position relative to the sea surface than the first structure fix-point 4*a*, with a first horizontal displacement distance at nominal position d2 to the first structure fix-point 4*a*, and with a first vertical displacement distance at nominal position d3 to the first structure fix-point 4*a*. In FIG. 1*b* the vessel 4 has moved out of its nominal position and the first structure fix-point 4*a* has a horizontal displacement distance d2* to the second structure fix-point 5*a*.

The pipe 3 has a catenary liftable length section extending between the first structure fix-point 4*a* and the second structure fix-point 5*a*, wherein the catenary liftable length section has a touch down point 6 at seabed at nominal position as shown in FIG. 1*a*, and if the first structure fix-point 4*a* is moved out of its nominal position as shown in FIG. 1*b*, the distance to the second structure fix-point 4*a* can be increased sufficiently to lift the catenary liftable length section from the seabed to form a catenary.

The pipe 3 extends beyond the second structure fix-point 5*a* and the catenary liftable length section in pipe 3*a* in a direction away from the second structure fix-point 5*a* and from the touch down point 6 at nominal position to a seabed structure 9, such as a well.

Figure 2:
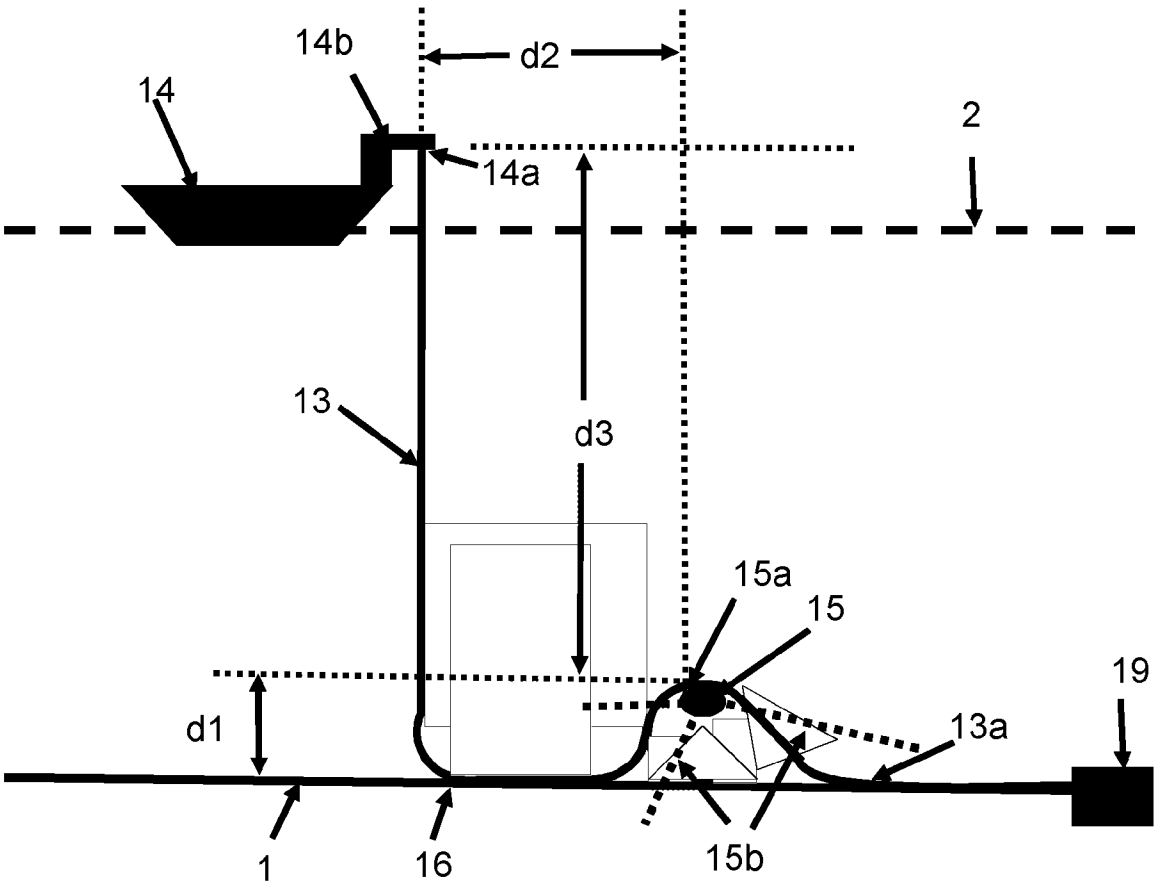
FIG. 2 is a schematic side view of a second offshore system in nominal position wherein the second structure is a moored mid water arch.

The offshore system shown in FIG. 2 is shown in its nominal position only, but can be out of nominal position in same manner as the offshore system shown in FIG. 1*a*. and FIG. 1*b*.

The offshore structure of FIG. 2 comprises a flexible transporting unit in the form of a flexible pipe 13 and a first movably structure fix-point 14*a* and a second structure fix-point 15*a*. The first movably structure fix-point 14*a* is a fix-point to a turret 14*b* of a vessel 14, such as a weather vaning vessel. The second structure fix-point 15*a* is a fix-point to a mid water arch 15, moored with mooring lines 15*b*.

The second structure fix-point 15*a* is arranged at a lower position relative to the sea surface than the first structure fix-point 14*a*, with a first horizontal displacement distance at nominal position d2 to the first structure fix-point 14*a*, and with a first vertical displacement distance at nominal position d3 to the first structure fix-point 14*a*.

The pipe 13 has a catenary liftable length section extending between the first structure fix-point 4*a* and the second structure fix-point 15*a*, wherein the catenary liftable length section has a touch down point 16 at seabed at nominal position. If the first structure fix-point 14*a* is moved out of its nominal position, the distance to the second structure fix-point 14*a* can be increased sufficiently to lift the catenary liftable length section from the seabed to form a catenary.

The pipe 13 extends beyond the second structure fix-point 15*a* and the catenary liftable length section in pipe 13*a* in a direction away from the second structure fix-point 15*a* and from the touch down point 16 at nominal position to a seabed structure 19, such as a well.

Figure 3:
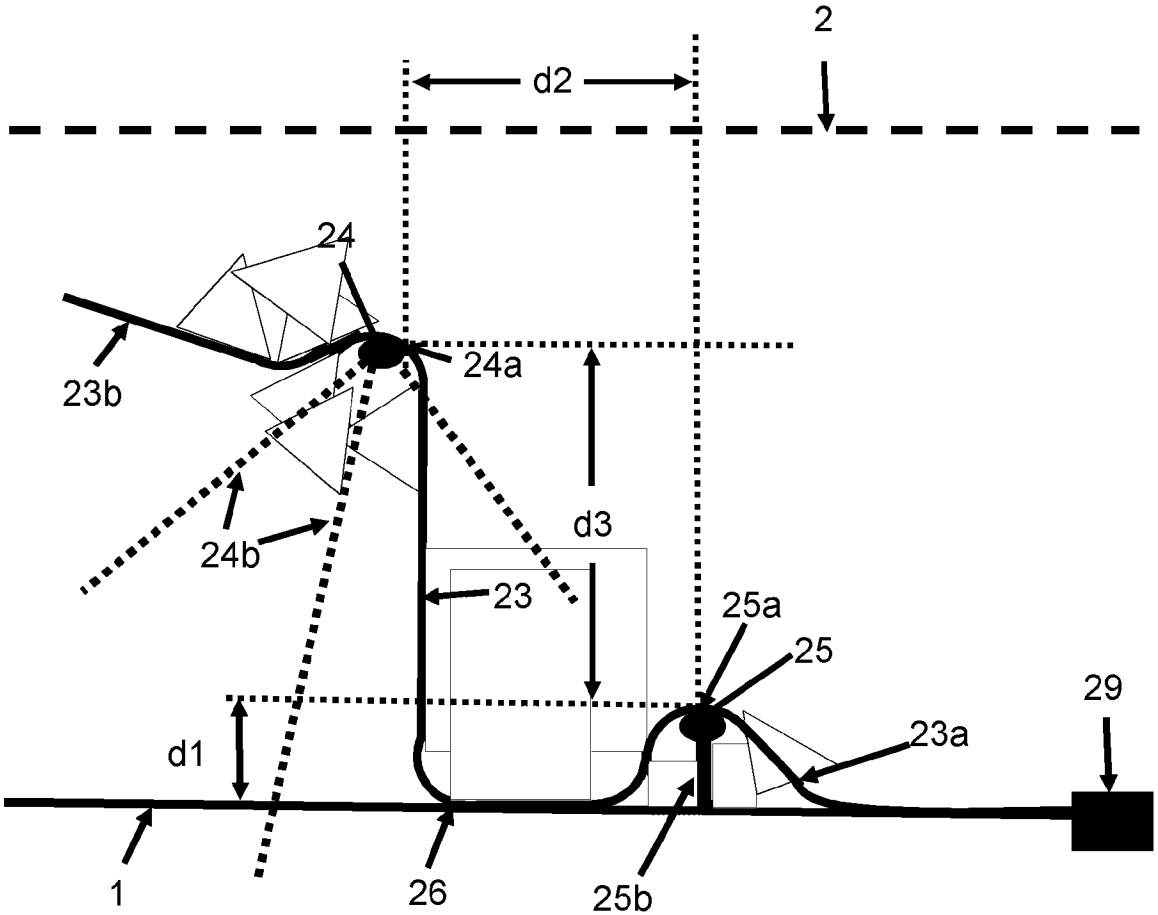
FIG. 3 is a schematic side view of a second offshore system in nominal position wherein the first structure is a moored mid water arch.

The offshore system shown in FIG. 3 is shown in its nominal position only, but can be out of nominal position in same manner as the offshore system shown in FIG. 1*a*. and FIG. 1*b*.

The offshore structure of FIG. 3 comprises a flexible transporting unit in the form of a flexible pipe 23 and a first movable structure fix-point 24*a* and a second structure fix-point 25*a*. The first movable structure fix-point 24*a* is a fix-point to a mid water arch 24, moored with mooring lines 24*b*.

The second structure fix-point 25*a* is a fix-point to a subsea structure comprising support structure 25 and a pillar 25*b* fixed to the seabed 1, such that the fix-point 25*a* is arranged at a horizontal distance d1 from the seabed 1.

The second structure fix-point 25*a* is arranged at a lower position relative to the sea surface than the first structure fix-point 24*a*, with a first horizontal displacement distance at nominal position d2 to the first structure fix-point 24*a*, and with a first vertical displacement distance at nominal position d3 to the first structure fix-point 24*a*.

The pipe 23 has a catenary liftable length section extending between the first structure fix-point 24*a* and the second structure fix-point 25*a*, wherein the catenary liftable length section has a touch down point 26 at seabed at nominal position. If the first structure fix-point 24*a* is moved out of its nominal position, the distance to the second structure fix-point 24*a* can be increased sufficiently to lift the catenary liftable length section from the seabed to form a catenary.

The pipe 23 extends beyond the second structure fix-point 25*a* and the catenary liftable length section in pipe 23*a* in a direction away from the second structure fix-point 25*a* and from the touch down point 26 at nominal position to a seabed structure 29, such as a well. The pipe 23 also extends beyond the first structure fix-point 24*a* and the catenary liftable length section in pipe 23*b* for example to a not shown floating sea surface structure e.g. a platform.

Figure 4:
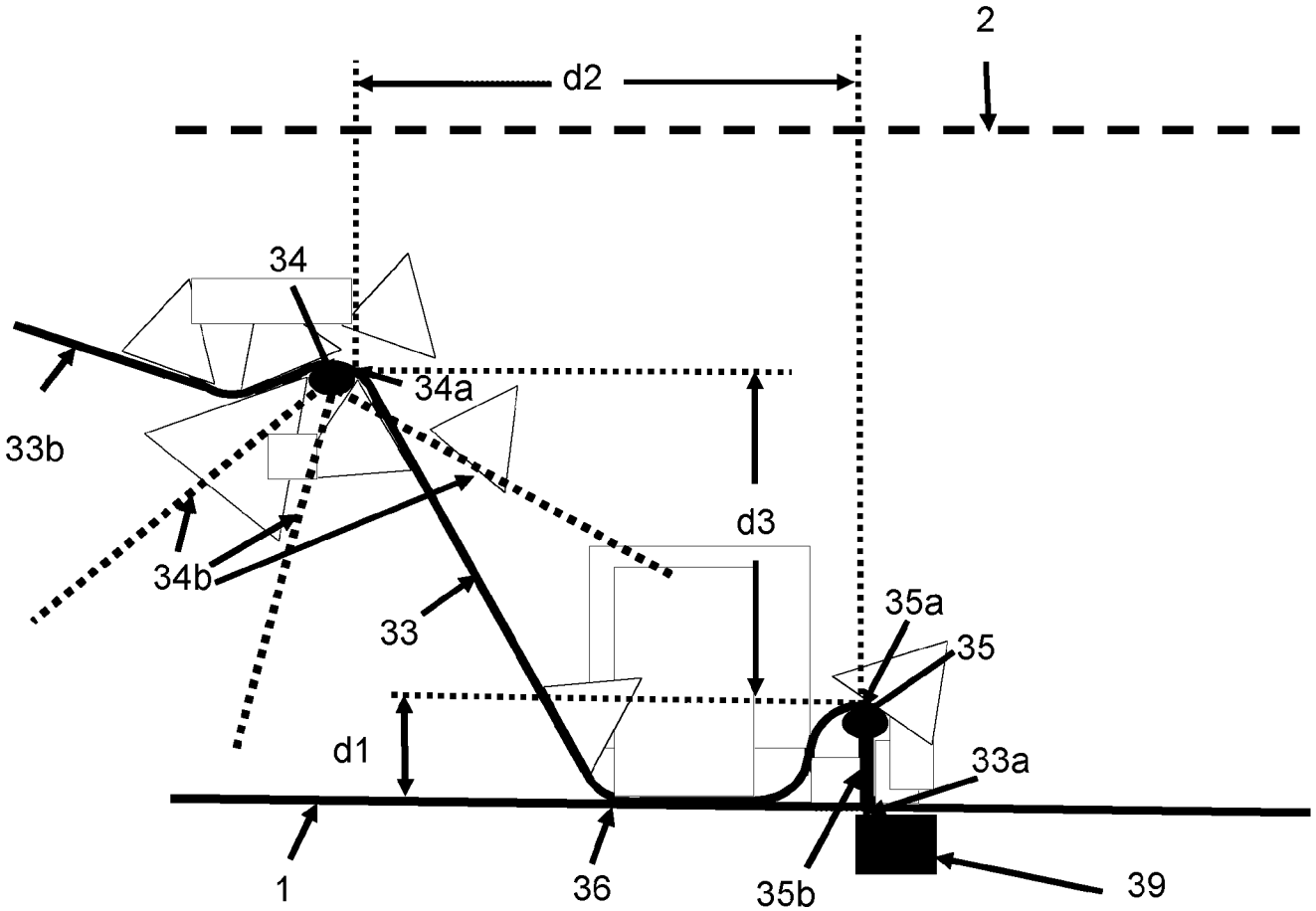
FIG. 4 is a schematic side view of a second offshore system in nominal position wherein the first structure is a moored mid water arch, and the second structure it a mono pile where the flexible transporting unit is guided downwards inside the mono pile.

The offshore system shown in FIG. 4 is shown in its nominal position only, but can be out of nominal position in same manner as the offshore system shown in FIG. 1*a*. and FIG. 1*b*.

The offshore structure of FIG. 4 comprises a flexible transporting unit in the form of a flexible pipe 33 and a first movable structure fix-point 34*a* and a second structure fix-point 35*a*. The first movable structure fix-point 34*a* is a fix-point to a mid water arch 34, moored with mooring lines 34*b*.

The second structure fix-point 35*a* is a fix-point to a subsea structure comprising support structure 35 and a pillar 35*b* fixed to the seabed 1, such that the fix-point 35*a* is arranged at a horizontal distance d1 from the seabed 1.

The second structure fix-point 35*a* is arranged at a lower position relative to the sea surface than the first structure fix-point 34*a*, with a first horizontal displacement distance at nominal position d2 to the first structure fix-point 34*a*, and with a first vertical displacement distance at nominal position d3 to the first structure fix-point 34*a*.

The pipe 33 has a catenary liftable length section extending between the first structure fix-point 34*a* and the second structure fix-point 35*a*, wherein the catenary liftable length section has a support structure 35 and a pillar 35*b* seabed at nominal position. If the first structure fix-point 34*a* is moved out of its nominal position, the distance to the second structure fix-point 34*a* can be increased sufficiently to lift the catenary liftable length section from the seabed to form a catenary.

The pipe 33 extends beyond the second structure fix-point 35*a* and the catenary liftable length section in pipe 33*a* in a direction downwards inside the support structure 35 and pillar 35*b* which is here a mono pile, to a seabed structure 39 arranged below the seabed. The pipe 33 also extends beyond the first structure fix-point 34*a* and the catenary liftable length section in pipe 33*b* for example to a not shown floating sea surface structure e.g. a platform.

Figure 4A:
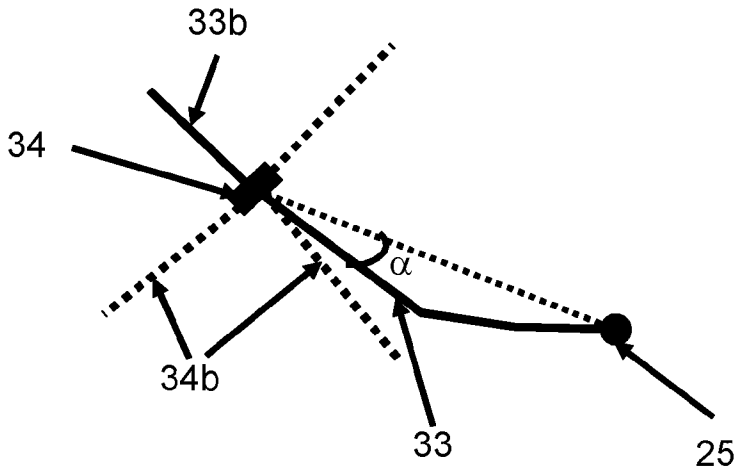
FIG. 4*a* is a schematic top view of the offshore system shown in FIG. 4.

FIG. 4*a* is a schematic top view of the offshore system shown in FIG. 4. As mentioned above a first horizontal displacement distance at nominal position d2 to the first structure fix-point 34*a*. This horizontal displacement defines a displacement direction and it can be seen that in this embodiment the touch down point 36 at seabed at nominal position is placed in a direction from said first structure fix-point 35*a* which is angled with the angle $\alpha$ which is in the interval +/−30 degree to the displacement direction.

Figure 5:
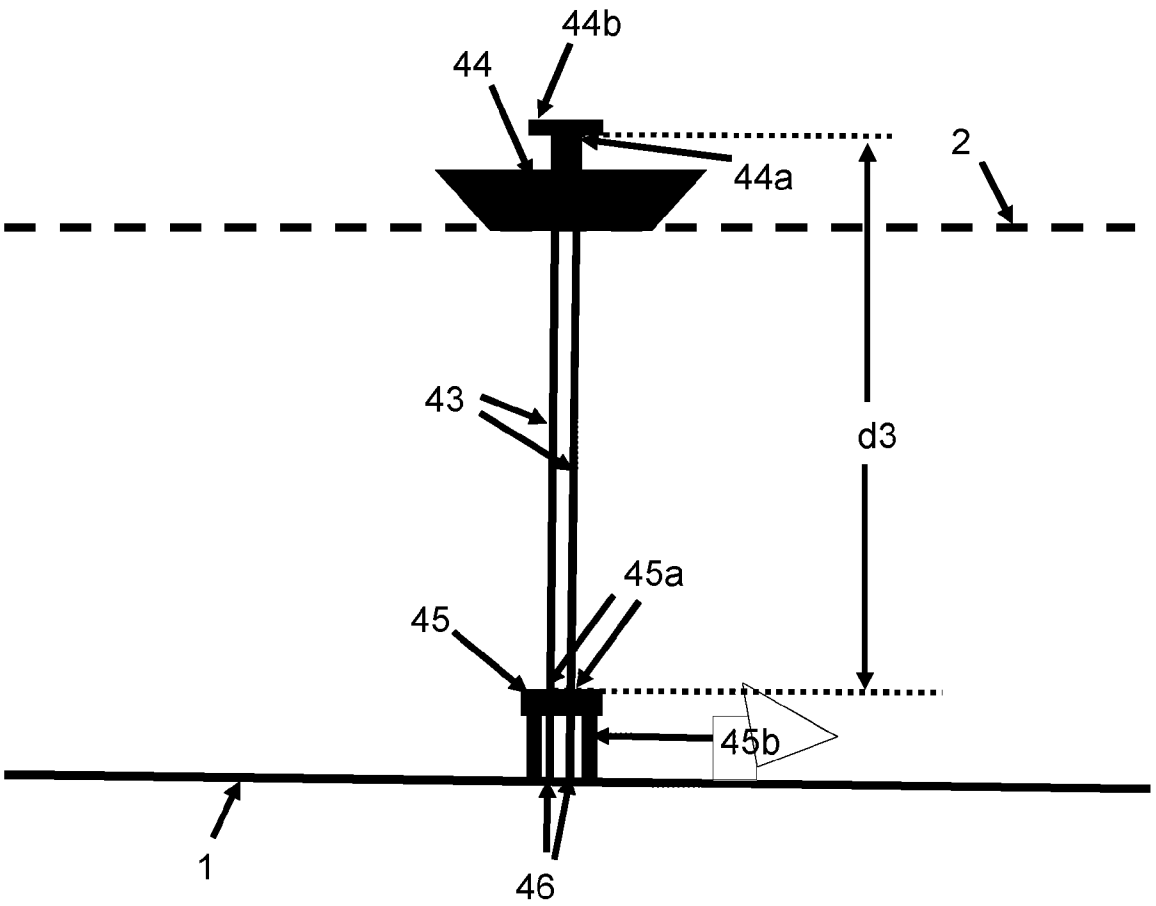
FIG. 5 is a schematic front view of an offshore system in nominal position comprising two flexible transporting units and wherein the second structure is a double pillar structure.

The offshore system of FIG. 5 is shown in a front view in nominal position.

The offshore structure comprises two flexible transporting units in the form of flexible pipe 43 and first movable structure fix-points 44*a* and second structure fix-points 45*a*. The first movable structure fix-points 44*a* are fix-point to a not shown turret of a vessel 44, such as a weathervaning vessel.

The second structure fix-points 45*a* are fix-points to a subsea structure comprising support structure 45 and pillars 45*b*.

The second structure fix-points 45*a* is arranged at a lower position relative to the sea surface than the first structure fix-points 44*a*, with a first vertical displacement distance at nominal position d3 to the first structure fix-points 44*a*.

The pipes 43 have a catenary liftable length sections extending between the first structure fix-points 44*a* and the second structure fix-points 45*a*, wherein the catenary liftable length sections have a touch down point 46 at seabed at nominal position.

Some preferred embodiments have been shown in the foregoing, but it should be stressed that the invention is not limited to these, but may be embodied in other ways within the subject-matter defined in the following claims.

What is claimed is:

1. An offshore system for transferring fluid at least partly below sea surface, the offshore system comprises:

an unbonded flexible transporting unit comprising an internal sealing sheath and at least two reinforcement layers which are not bonded to each other, a first movable structure with a first movable structure fix-point with a nominal position, and a second structure with a second structure fix-point arranged at a distance to a seabed and at a lower position relative to the sea surface than the first structure fix-point, wherein:

the flexible transporting unit is fixed to respectively the first structure fix-point and the second structure fix-point to provide a catenary liftable length section of the flexible transporting unit extending between the first structure fix-point and the second structure fix-point, the catenary liftable length section has at least a touch down point at the seabed at the nominal position of said first structure fix-point, and if the first structure fix-point is moved out of its nominal position, the distance from the first structure fix-point to the second structure fix-point is sufficiently increasable to lift the catenary liftable length section from the seabed to form a catenary.

2. The offshore system as claimed in claim 1, wherein the first structure fix-point in its nominal position is arranged at a distance to the second structure fix-point which is about 0.95 times or less than the length of the catenary liftable length section of the transporting unit.

3. The offshore system as claimed in claim 1, wherein the first structure fix-point in its nominal position is arranged at a distance to the second structure fix-point which is between about 0.5 and about 0.98 times the length of the catenary liftable length section of the transporting unit.

4. The offshore system as claimed in claim 1, wherein the first structure fix-point is arranged horizontally displaced with a first horizontal displacement distance at nominal position to the second structure fix-point and vertically displaced with a first vertical displacement distance at nominal position to the second structure fix-point, wherein the first horizontal displacement distance is at least about 1 m.

5. The offshore system as claimed in claim 4, wherein the first horizontal displacement distance is between about 1 m and about 300 m.

6. The offshore system as claimed claim 1, wherein the first structure fix-point is arranged horizontally displaced with a first horizontal displacement distance at nominal position to the second structure fix-point and vertically displaced with a first vertical displacement distance at nominal position to the second structure fix-point, wherein the first horizontal displacement distance is between about 0.02 and about 0.95 times the length of the catenary liftable length section of the transporting unit.

7. The offshore system as claimed in claim 1, wherein the first structure fix-point is arranged vertically displaced with a first vertical displacement distance at nominal position to the second structure fix-point, wherein the first vertical displacement distance is up to a max distance determined as the distance between about 20 m above the sea surface and the seabed at the touch down point.

8. The offshore system as claimed in claim 1, wherein the first structure fix-point is arranged vertically displaced with a first vertical displacement distance at nominal position to the second structure fix-point, wherein the first vertical displacement distance is between a max distance determined as 1.5 times the distance from about the sea surface to about the seabed at the touch down point and a min distance determined as 0.1 times the distance from about the sea surface to about the seabed at the touch down point.

9. The offshore system as claimed in claim 1, wherein the first structure fix-point is arranged horizontally displaced with a first horizontal displacement distance at nominal position to the second structure fix-point and vertically displaced with a first vertical displacement distance at nominal position to the second structure fix-point, wherein the sum of the first horizontal displacement distance and the first vertical displacement distance is between about 0.7 and about 1.5 times the length of the catenary liftable length section of the transporting unit.

10. The offshore system as claimed in claim 1, wherein the first structure is a floating sea surface installation.

11. The offshore system as claimed in claim 10, wherein the first structure fix-point is a fix-point of the first structure to a turret of a vessel above sea surface.

12. The offshore system as claimed in claim 1, wherein the first structure is a mid water arch, the mid water arch is anchored to the seabed and/or moored to provide its nominal position.

13. The offshore system as claimed in claim 12, wherein the mid water arch comprises gutters, the flexible transporting unit is laid over the mid water arch into the gutters and is fixed by a clamping system.

14. The offshore system as claimed in claim 1, wherein the second structure is a mid water arch, the mid water arch is anchored to the seabed and/or moored to provide a nominal position.

15. The offshore system as claimed in claim 1 wherein, the second structure is a subsea structure fixed to the seabed, the second structure is a pillar with a support structure comprising gutters, the flexible transporting unit is laid into the gutters and is fixed by a clamping system.

16. The offshore system as claimed in claim 1, wherein the second structure fix-point is arranged at a preselected distance from the seabed.

17. The offshore system as claimed in claim 1, wherein the first structure fix-point is arranged horizontally displaced with a first horizontal displacement distance at nominal position to the second structure fix-point and the second structure fix-point is arranged at a distance from the seabed which is in the interval from about 0.05 times and 1 time the first horizontal displacement distance.

18. The offshore system as claimed in claim 1, wherein the first structure fix-point is arranged horizontally displaced with a first horizontal displacement distance and displacement direction at nominal position to the second structure fix-point, wherein said touch down point at seabed at nominal position is placed in a direction from said first structure fix-point which is substantially parallel to the displacement direction +/−30 degree.

19. The offshore system as claimed in claim 1, wherein the flexible transporting unit is substantially provided by said catenary liftable length section.

20. The offshore system as claimed in claim 1, wherein the flexible transporting unit extends beyond at least one of the first structure fix-point and the second structure fix-point.

21. The offshore system as claimed in claim 1, wherein the flexible transporting unit or a secondary transporting unit system extends beyond the second structure fix-point in a direction away from the second structure fix-point which also is a direction away from the touch down point at seabed at nominal position.

22. The offshore system as claimed in claim 1, wherein the offshore system is arranged for transferring fluid from a seabed installation to a sea surface installation.

23. The offshore system as claimed in claim 1, wherein the flexible transporting unit in its catenary liftable length section is free of local buoyancy module(s).

24. The offshore system as claimed in claim 1, wherein the flexible transporting unit is a flexible pipe or an umbilical.

* * * * *